United States Patent [19]

Baillargeon et al.

[11] Patent Number: 5,039,306

[45] Date of Patent: Aug. 13, 1991

[54] MULTIFUNCTIONAL ADDITIVES TO IMPROVE THE LOW-TEMPERATURE PROPERTIES OF DISTILLATE FUELS AND COMPOSITIONS THEREOF

[75] Inventors: David J. Baillargeon, West Windsor; Angeline B. Cardis, Florence; Dale B. Heck, West Deptford, all of N.J.

[73] Assignee: Mobil Oil Corp., Fairfax, Va.

[21] Appl. No.: 449,183

[22] Filed: Dec. 13, 1989

[51] Int. Cl.[5] ..... C10L 1/14

[52] U.S. Cl. ..... 44/331; 44/391; 525/437; 564/134; 564/144; 564/169

[58] Field of Search ..... 44/62, 72, 71, 75, 78, 44/63; 525/437; 564/134, 144, 169

[56] References Cited

U.S. PATENT DOCUMENTS

| | | | |
|---|---|---|---|
| 2,594,145 | 4/1952 | Flory | 525/420 |
| 3,397,255 | 8/1968 | Coats et al. | 525/437 |
| 3,882,085 | 5/1975 | Schmitt et al. | 525/420 |
| 4,061,621 | 12/1977 | Lofquist | 525/420 |
| 4,236,898 | 12/1980 | Davis et al. | 44/72 |
| 4,290,778 | 9/1981 | Herbstman et al. | 44/71 |
| 4,328,142 | 5/1982 | Hertel et al. | 525/420 |
| 4,402,708 | 9/1983 | Oswald | 44/62 |
| 4,404,001 | 9/1983 | Kaufman | 44/71 |
| 4,430,093 | 2/1984 | Jenkins, Jr. | 44/70 |
| 4,659,337 | 4/1987 | Sung | 44/71 |
| 4,690,980 | 9/1987 | Singer et al. | 525/286 |
| 4,732,948 | 3/1988 | McCready et al. | 525/437 |
| 4,744,798 | 5/1988 | Andress | 44/63 |

*Primary Examiner*—Margaret B. Medley

*Attorney, Agent, or Firm*—Alexander J. McKillop; Charles J. Speciale; Howard M. Flournoy

[57] ABSTRACT

Additives which improve the low-temperature properties of distillate fuels are the reaction products of (1) diols, and (2) the product of pyromellitic dianhydride and aminoalcohols and/or amines with long-chain hydrocarbyl groups attached.

40 Claims, No Drawings

MULTIFUNCTIONAL ADDITIVES TO IMPROVE THE LOW-TEMPERATURE PROPERTIES OF DISTILLATE FUELS AND COMPOSITIONS THEREOF

BACKGROUND OF THE INVENTION

This application is directed to multifunctional additives derived from diols and pyromellitic dianhydride (PMDA) reaction products and to fuel compositions containing same or more particular to distillate fuel compositions containing same.

Traditionally, the low-temperature properties of distillate fuels have been improved by the addition of kerosene, sometimes in very large amounts (5–70 wt %). The kerosene dilutes the wax in the fuel, i.e., lowers the overall weight fraction of wax, and thereby lowers the cloud point, filterability temperature, and pour point simultaneously. The additives of this invention effectively lower both the cloud point and CFPP of distillate fuel without any appreciable dilution of the wax component of the fuel.

Other additives known in the art have been used in lieu of kerosene to improve the low-temperature properties of distillate fuels. Many such additives are polymeric materials with pendent fatty hydrocarbon groups, and are usually derived from the free radical polymerization of unsaturated hydrocarbons (olefins, acrylates, fumarates, etc.). These additivees are limited in their range of activity, however; most improve fuel properties by lowering the pour point and/or filterability temperature. These same additives have little or not effect on the cloud point of the fuel.

Applicants to the best of their knowledge are unaware of any art that teaches or suggests the additive products disclosed herein. U.S. Pat. No. 4,524,007, for example, discloses the use of polycarboxylic acids/anhydrides such as PMDA (pyromellitic dianhydride) reacted with ether capped alcohols to provide demulsifying additives for lubricants.

The additives of this invention are substantially different, however, both in terms of structure and function. They are oligomeric and/or polymeric materials obtained via condensation reactions, e.g., the reaction of diols with acids and/or anhydrides. In terms of activity, these additives effectively lower distillate fuel cloud point, thus providing improved low-temperature fuel properties, and offering a unique and useful advantage over known distillate fuel additives.

SUMMARY OF THE INVENTION

Novel oligomeric/polymeric pyromellitate esters and ester/amides have been prepared and have been found to be suprisingly active wax crystal modifier additives for distillate fuels. Distillate fuel compositions containing minor amounts of such additives demonstrate significantly improved low-temperature flow properties, with lower cloud point and lower CFPP filterability temperature.

These oligomeric/polymeric additives are the reaction products derived from two types of monomer components. The first monomer type is a diol, either along or in combination with other diols. The second monomer type is the reactive acid/anhydride product, either alone or in combination with other such monomers, derived from the reaction of pyromellitic dianhydride (PMDA) with either (a) an aminoalcohol, the product of an amine and an epoxide, or (b) a combination of an aminoalcohol (above, a) and an amine.

These new additives are especially effective in lowering the cloud point of distillate fuels, and thus improve the low-temperature flow properties of such fuels without the use of any light hydrocarbon diluent, such as kerosene. In addition, the filterabilty properties are improved as demonstrated by lower CFPP temperatures. Thus, the additives of this invention demonstrate multifunctional activity in distillate fuels.

The additive compositions, described herein have cloud point activity and CFPP activity and are unique in structure and activity. The additive concentrates and fuel compositions containing such additives are also unique. Similarly, the processes for making these additives, additive concentrates, and fuel compositions are unique.

DESCRIPTION OF SPECIFIC EMBODIMENTS

The additives of this invention have oligomeric (i.e. dimers, trimers, etc.) and/or polymeric structures. Various hydrocarbyl groups, especially groups with linear paraffinic substructures attached, are distributed along the backbone of the oligomer and/or polymer, and may be carried by either or both of the comonomers used.

One of the comonomers, alone or in combination, used in the synthesis of these additives is a diol. Any diol may be used in this invention and suitable diols may encompass, but are not limited to, examples of the following types: 1,2-diols, 1,3-diols, 1,4-diols, alpha-omega-diols, ether diols, polyether diols, glyceryl monoesters, and any other hydrocarbyl diols. Highly suitable diols include but are not limited to 1,2-octadecanediol, 1,4-butane-diol, 1,12-dodecanediol, poly(ethyleneglycol), poly(propyleneglycol).

The other comonomer used, alone or in combination, in the synthesis of these additives is a reactive acid and/or anhydride derived from the reaction of pyromellitic dianhydride (PMDA) or its acid equivalent, and suitable pendant groups derived from alcohols and amines with some combination of linear hydrocarbyl groups attached. These pendant groups include (a) aminoalcohols, derived from a secondary amine capped with an olefin epoxide, (b) combinations of the aminalcohol from (a) and an amine, and (c) combinations of two or more different aminoalcohols. Preferred amines are secondary amines such as di(hydrogenated tallow) amine. Preferred epoxides are such epoxides as 1,2-epoxyoctadecane.

The additives of this invention are the reaction products obtained by combining the two monomer types described above in differing ratios using standard esterification techniques according to the following stepwise procedure:

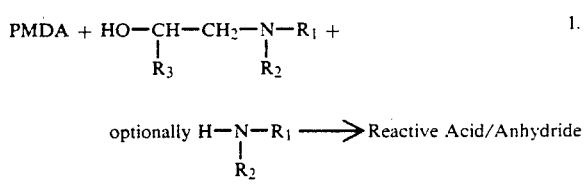

1.

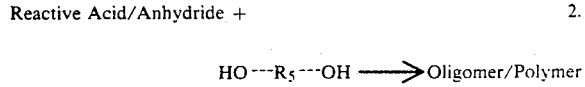

2.

For example a general structure for the oligomers/polymers derived from PMDA partial ester and diol is as follows:

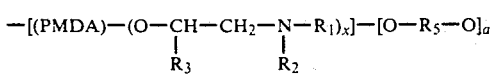

A general structure for the oligomers/polymers derived from PMDA mixed partial ester and diol is as follows:

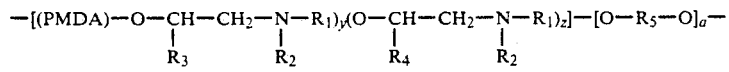

A general structure for the oligomers/polymers derived from PMDA partial ester/amide and diol is as follows:

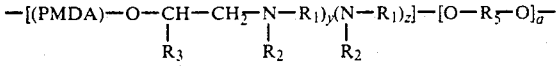

Where:

$x=y+z=0.5$ to about 3.5, and preferably 1 to about 3.

$a=0.25$ to 2, and preferably 0.5 to about 1.25.

$R_1$, $R_3=C_8$ to $C_{30}$ linear hydrocarbyl groups, either saturated or unsaturated.

$R_2=R_1$, or $C_1$ to $C_{100}$ hydrocarbyl $R_4=H$, or $C_2$ to $C_{100}$ hydrocarbyl $R_5=C_2$ to $C_{100}$ hydrocarbyl The process in accordance with this invention can conveniently take place in a single pot reaction wherein a suitable amine and an epoxide are first reacted and thereafter the PMDA and a suitable diol are added to the reaction zone.

More than molar, less than molar or substantially molar quantitives of the various reactants may be used. Generally the reaction takes place under standard esterification conditions which may, however, vary widely as to temperature, time and pressure. The temperature may vary from 100° to 250° C., preferably 150° to 200° C., the pressure may vary from 0.001 atm to 10 atm and preferably 0.001 atm to 1 atm. The reaction time for the overall process may vary from 1 to 24 to 36 to 48 hours or more.

In general, the reaction products of the present invention may be employed in fuel compositions in any amount effective for imparting thereto the desired degree of activity to improve the low temperature characteristics of distillate fuels. In many applications the products are effectively employed in amounts from about 0.001% to about 10% by weight and preferably from less than 0.1% to about 5% of the total weight of the composition. These additives may be used in conjunction with other known low-temperature fuel additives (dispersants, etc.) being used for their intended purpose.

The fuels contemplated are liquid hydrocarbon combustion fuels, including the distillate fuels and fuel oils. Accordingly, the fuel oils that may be improved in accordance with the present invention are hydrocarbon fractions having an initial boiling point of at least about 250° F. and an end-boiling point no higher than about 750° F. and boiling substantially continuously throughout their distillation range. Such fuel oils are generally known as distillate fuel oils. It is to be understood, however, that this term is not restricted to straight run distillate fractions. The distillate fuel oils can be straight run distillate fuel oils, catalytically or thermally cracked (including hydrocracked) distillate fuel oils, or mixtures of straight run distillate fuel oils, naphthas and the like, with cracked distillate stocks. Moreover, such fuel oils can be treated in accordance with well-known commercial methods, such as, acid or caustic treatment, hydrogenation, solvent refining, clay treatment, etc.

The distillate fuel oils are characterized by their relatively low viscosities, pour points, and the like. The principal property which characterize the contemplated hydrocarbons, however, is the distillation range. As mentioned hereinbefore, this range will lie between about 250° F. and about 750° F. Obviously, the distillation range of each individual fuel oil will cover a narrower boiling range falling, nevertheless, within the above-specified limits. Likewise, each fuel oil will boil substantially continuously throughout its distillation range.

Contemplated among the fuel oils are Nos. 1, 2 and 3 fuel oils used in heating and as diesel fuel oils, and the jet combustion fuels. The domestic fuel oils generally conform to the specification set forth in A.S.T.M. Specifications D396-48T. Specifications for diesel fuels are defined in A.S.T.M. Specification D975-48T, Typical jet fuels are defined in Military Specification MIL-F-5624B.

The following examples are illustrative only and are not intended to limit the scope of the invention.

EXAMPLES

Example 1

Preparation of Additive 1

Di(hydrogenated tallow) amine (49.9 g, 0.10 mol; e.g. Armeen 2HT from Akzo Chemie), and 1,2-epoxyoctadecane (33.6 g, 0.125 mol; e.g. Vikolox 18 from Viking Chemical) were combined and heated at 165° C. for 18 hours. Pyromellitic dianhydride (6.23 g, 0.028 mol; e.g. PMDA from Allco Chemical Corp.), 1,2-octadecanediol (2.05 g, 0.007 mol; e.g. Vikinol 18 from Viking Chemical), and xylene (approximately 50 ml) were added and heated at reflux (180° to 240° C.) with azeotropic removal of water for 24 to 36 hours. Volatiles were then removed from the reaction medium at 190° to 200° C., and the reaction mixture was hot filtered through diatomaceous earth to give 82.7 g of the final product.

Example 2

Preparation of Additive 2

According to the procedure used for Example 1 (above), di(hydrogenated tallow) amine (49.9 g, 0.10 mol), and 1,2-epoxyoctadecane (33.6 g, 0.125 mol) were combined. Then, pyromellitic dianhydride (7.27 g, 0.033 mol), 1,2-octadecanediol (4.78 g. 0.017 mol), and xylene (approximately 50 ml) were added and allowed to react. After isolation, 85.0 g of the final product was obtained.

Example 3

Preparation of Additive 3

According to the procedure used for Example 1 (above), di(hydrogenated tallow) amine (49.9 g, 0.10 mol), and 1,2-epoxyoctadecane (33.6 g, 0.125 mol) were combined. Then, pyromellitic dianhydride (8.72 g, 0.040 mol), 1,2-octadecanediol (8.60 g, 0.030 mol), and xylene (approximately 50 ml) were added and allowed to react. After isolation, 90.5 g of the final product was obtained.

Example 4

Preparation of Additive 4

According to the procedure used for Example 1 (above), di(hydrogenated tallow) amine (49.9 g, 0.10 mol), and 1,2-epoxyoctadecane (33.6 g, 0.125 mol) were combined. Then, pyromellitic dianhydride (7.27 g, 0.033 mol), 1,4-butanediol (1.50 g, 0.017 mol; e.g. from Aldrich Chemical Company), and xylene (approximately 50 ml) were added and allowed to react. After isolation, 81.6 g of the final product was obtained.

Example 5

Preparation of Additive 5

According to the procedure used for Example 1 (above), di(hydrogenated tallow) amine (49.9 g, 0.10 mol), and 1,2-epoxyoctadecane (33.6 g, 0.125 mol) were combined. Then, pyromellitic dianhydride (8.72 g, 0.040 mol), 1,4-butanediol (2.70 g, 0.030 mol), and xylene (approximately 50 ml) were added and allowed to react. After isolation, 84.3 g of the final product was obtained.

Example 6

Preparation of Additive 6

Di(hydrogenated tallow) amine (49.9 g, 0.10 mol), and 1,2-epoxyoctadecane (33.6 g, 0.125 mol) were combined and heated at 170° C. for 18 hours. Pyromellitic dianhydride (8.00 g, 0.037 mol), 1,12-dodecanediol (3.37 g, 0.017 mol; e.g. from Aldrich Chemical Company), and xylene (approximately 50 ml) were added and heated at reflux (190° to 200° C.) with azeotropic removal of water for 24 hours. Volatiles were then removed from the reaction medium at 190° to 200° C., and the reaction mixture was hot filtered through diatomaceous earth to give 87.1 g of the final product.

Example 7

Preparation of Additive 7

According to the procedure used for Example 6 (above), di(hydrogenated tallow) amine (49.9 g, 0.10 mol), and 1,2-epoxyoctadecane (33.6 g, 0.125 mol) were combined. Then, pyromellitic dianhydride (12.0 g, 0.055 mol, 1,12-dodecanediol (9.11 g, 0.045 mol), and xylene (approximately 50 ml) were added and allowed to react. After isolation, 91.4 g of the final product was obtained.

Example 8

Preparation of Additive 8

According to the procedure used for Example 6 (above), di(hydrogenated tallow) amine (49.9 g, 0.10 mol), and 1,2-epoxyoctadecane (33.6 g, 0.125 mol) were combined. Then, pyromellitic dianhydride (8.00 g, 0.037 mol, poly(ethyleneglycol with average M.W. 400 (6.67 g, 0.017 mol; e.g. from Aldrich Chemical Company), and xylene (approximately 50 ml) were added and allowed to react. After isolation, 84.7 g of the final product was obtained.

Example 9

Preparation of Additive 9

According to the procedure used for Example 6 (above), di(hydrogenated tallow) amine (49.9 g, 0.10 mol), and 1,2-epoxyoctadecane (33.6 g, 0.125 mol) were combined. Then, pyromellitic dianhydride (12.0 g, 0.055 mol, poly(ethyleneglycol with average M.W. 400 (22.0 g, 0.055 mol, and xylene (approximately 50 ml) were added and allowed to react. After isolation, 78.0 g of the final product was obtained.

Example 10

Preparation of Additive 10

According to the procedure used for Example 6 (above), di(hydrogenated tallow) amine (49.9 g, 0.10 mol), and 1,2-epoxyoctadecane (33.6 g, 0.125 mol) were combined. Then, pyromellitic dianhydride (8.00 g, 0.037 mol, poly(propyleneglycol with average M.W. 400 (6.67 g, 0.017 mol; e.g. JEFFOX PPG-400 from Texaco Chemical Company), and xylene (approximately 50 ml) were added and allowed to react. After isolation, 88.2 g of the final product was obtained.

Example 11

Preparation of Additive 11

According to the procedure used for Example 6 (above), di(hydrogenated tallow) amine (49.9 g, 0.10 mol), and 1,2-epoxyoctadecane (33.6 g, 0.125 mol) were combined. Then, pyromellitic dianhydride (12.0 g, 0.055 mol), poly(propyleneglycol with average M.W. 400 (22.0 g, 0.055 mol), and xylene (approximately 50 ml) were added and allowed to react. After isolation, 112.6 g of the final product was obtained.

Example 12

Preparation of Additive 12

According to the procedure used for Example 6 (above), di(hydrogenated tallow) amine (40.0 g, 0.08 mol), and 1,2-epoxyoctadecane (26.8 g, 0.10 mol) were combined. Then, pyromellitic dianhydride (9.60 g, 0.044 mol, poly(propyleneglycol with average M.W. 2000 (40.0 g, 0.020 mol; JEFFOX PPG-2000 from Texaco Chemical Company), and xylene (approximately 50 ml) were added and allowed to react. After isolation, 105.0 g of the final product was obtained.

Example 13

Preparation of Additive 13

According to the procedure used for Example 6 (above), di(hydrogenated tallow) amine (35.0 g, 0.07 mol), and 1,2-epoxyoctadecane (23.5 g, 0.088 mol) were combined. Then, pyromellitic dianhydride (8.40 g, 0.038 mol, poly(propyleneglycol with average M.W. 2000 (73.5 g, 0.037 mol), and xylene (approximately 50 ml) were added and allowed to react. After isolation, 131.7 g of the final product was obtained.

Example 14

Preparation of Additive 14

According to the procedure used for Example 6 (above), di(hydrogenated tallow) amine (51.0 g, 0.10 mol), and 1,2-epoxyoctadecane (14.2 g, 0.050 mol) were combined. Then, pyromellitic dianhydride (10.9 g, 0.050 mol, 1,12-dodecanediol (9.11 g, 0.045 mol), and xylene (approximately 50 ml) were added and allowed to react. After isolation, 71.6 g of the final product was obtained.

Example 15

Preparation of Additive 15

According to the procedure used for Example 6 (above), di(hydrogenated tallow) amine (40.8 g, 0.080 mol), and 1,2-epoxyoctadecane (11.4 g, 0.040 mol) were combined. Then, pyromellitic dianhydride (8.72 g, 0.040 mol, poly(propyleneglycol with average M.W. 2000 (40.0 g, 0.020 mol), and xylene (approximately 50 ml) were added and allowed to react. After isolation, 89.5 g of the final product was obtained.

PREPARATION OF ADDITIVE CONCENTRATE

A concentrate solution of 100 ml total volume was prepared by dissolving 10 g of additive in mixed xylenes solvent. Any insoluble particulates in the additive concentrate were removed by filtration before use.

TEST PROCEDURES

The cloud point of the additized distillate fuel was determined using two procedures:

(a) an automatic cloud point test based on the equipment/procedure detailed in U.S. Pat. No. 4,601,303; the test dsignation (below) is "AUTO CP".

(b) an automatic cloud point test based on the commercially available Herzog cloud point tester; the test designation (below) is "HERZOG."

The low-temperature filterability was determined using the Cold Filter Plugging Point (CFPP) test. This test procedure is described in *Journal of the Instutite of Petroleum*, Volume 32, Number 510, June 1966, pages 173–185.

TABLE

Additive Effects on the Cloud Point and Filterability (CFPP) of Distillate Fuel (Additive Concentration = 0.1 wt %)

| | Improvement in Performance Temperature (°F.) | | | | | |
|---|---|---|---|---|---|---|
| | Diesel Fuel A | | | Diesel Fuel B | | |
| | Cloud Point | | | Cloud Point | | |
| Additive | (Auto CP) | (Herzog) | CFPP | (Auto CP) | (Herzog) | CFPP |
| 1 | 4 | 2 | 4 | 6 | 5.9 | 4 |
| 2 | 4 | 2.2 | 4 | 7. | 5.9 | 2 |
| 3 | 3 | 2.4 | 6 | 8 | 5.4 | 4 |
| 4 | 4 | 2.2 | 4 | 6 | 4.9 | 2 |
| 5 | 3 | 2.4 | 4 | 7 | 5.9 | 2 |
| 6 | | 2 | 6 | | 7 | 11 |
| 7 | | 1.8 | 6 | | 6.7 | 7 |
| 8 | | 1.6 | 6 | | 6.1 | 9 |
| 9 | | 1.5 | 4 | | 4.7 | 6 |
| 10 | | 2 | 6 | | 6.5 | 11 |
| 11 | | 2 | 4 | | 7.4 | 6 |
| 12 | | 3.8 | 4 | | 7.2 | 6 |
| 13 | | 3.3 | 6 | | 6.3 | 6 |
| 14 | | 1.6 | | | 7.0 | 9 |
| 15 | | 2.7 | | | 4.3 | 6 |

TABLE-continued

Additive Effects on the Cloud Point and Filterability (CFPP) of Distillate Fuel (Additive Concentration = 0.1 wt %)

| | Test Fuel Characteristics | |
|---|---|---|
| | FUEL A | FUEL B |
| API Gravity | 35.5 | 34.1 |
| Cloud Point, °F. | | |
| Auto CP | 15 | 22 |
| Herzog | 16.4 | 23.4 |
| CFPP, °F. | 9 | 16 |
| Pour Point, °F. | 10 | 0 |

The test data clearly illustrate the improved low-temperature characteristics of distillate fuels which incorporate minor amounts of the novel additive products of this invention.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A liquid hydrocarbyl fuel additive product of reaction obtained by reacting in differing ratios a hydrocarbyl diol or mixture of hydrocarbyl diols and a reactive acid and/or anhydride derived from the reaction of pyromellitic dianhydride or its acid equivalent and hydrocarbyl groups derived from aminoalcohols, derived from secondary amines capped with an olefin oxide, having a combination of hydrocarbyl groups attached thereto by combining the reactants under standard esterification techniques in accordance with the following stepwise procedure:

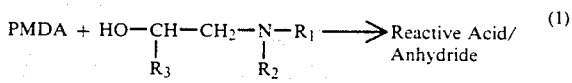

(1)

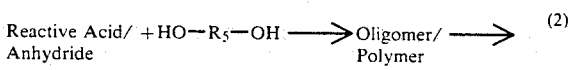

(2)

Where:

$R_1$, $R_3$=$C_8$ to $C_{30}$ hydrocarbyl groups, $R_2$=$R_1$, $C_1$ to $C_{100}$ hydrocarbyl, and $R_5$=$C_2$ to $C_{100}$ hydrocarbyl and wherein said differing ratios are less than molar ratios, substantially molar ratios and more than molar ratios and where the temperature of reaction varies from about 150° C. to 200° C., at pressure of from about 0.001 atm to 1 atm.

2. The product of claim 1 wherein the oligomer/polymer is derived from pyromellitic dianhydride partial ester and diol and has a general structure as follows:

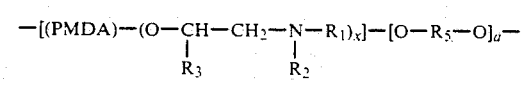

Where a=0.25 to about 2 x=0.5 to about 3.5

3. The product of claim 1 wherein the oligomer/polymer is derived from pyromellitic dianhydride mixed partial ester and diol and has a general structure as follows:

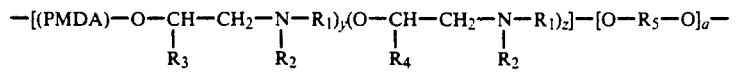

Where a=0.25 to about 2 y+z=0.5 to about 3.5

$R_4$=hydrogen or $C_1$ to about $C_{100}$ hydrocarbyl

4. The product of claim 1 wherein the oligomer/polymer is derived from pyromellitic dianhydride partial ester/amide and diol and has a general structure as follows:

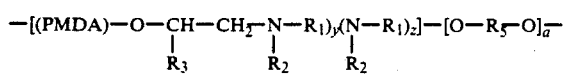

Where a=0.25 to about 2 y+z=0.5 to about 3.5

5. The product of claim 1 obtained by reacting di(hydrogenated tallow) amine, 1,2-epoxyoctadecane, pyromellitic dianhydride and 1,2-octadecanediol.

6. The product of claim 1 obtained by reacting di(hydrogenated tallow) amine, pyromellitic dianhydride and 1,4-butanediol.

7. The product of claim 1 obtained by reacting di(hydrogenated tallow) amine, 1,2-epoxyoctadecane, pyromellitic dianhydride, 1,12-dodecanediol.

8. The product of claim 1 obtained by reacting di(hydrogenated tallow) amine, 1,2-epoxyoctadecane, pyromellitic dianhydride, and poly(ethyleneglycol).

9. The product of claim 7 wherein the poly(ethleneglycol) has an average M.W. of 400.

10. The product of claim 1 obtained by reacting di(hydrogenated tallow) amine, 1,2-epoxyoctadecane, pyromellitic dianhydride, and poly(propyleneglycol).

11. The product of claim 9 wherein the poly(propyleneglycol) has an average M.W. 2000.

12. A fuel composition comprising a major proportion of a liquid hydrocarbyl fuel and a minor proportion comprising from about 0.001 wt % to about 10 wt % based on the total weight of the composition of an additive product of reaction obtained by reacting in differing ratios a hydrocarbyl diol or mixture of hydrocarbyl diols and a reactive acid and/or anhydride derived from the reaction of pyromellitic dianhydride or its acid equivalent having hydrocarbyl groups derived from aminoalcohols, derived from secondary amines capped with an olefin oxide, having a combination of hydrocarbyl groups attached thereto and wherein said differing ratios are less than molar ratios, substantially molar ratios and more than molar ratios and where the temperature of reaction varies from about 150° C. to 200° C., at pressure of from about 0.001 atm to 1 atm.

13. The fuel composition of claim 12 obtained by combining under standard esterification techniques in accordance with the following stepwise procedure:

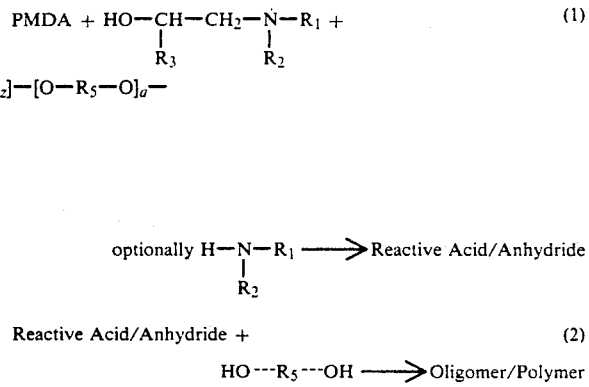

Where $R_1$, $R_3$=$C_8$ to $C_{30}$ hydrocarbyl groups, $R_2$=$R_1$, $C_1$ to $C_{100}$ hydrocarbyl, and $R_5$=$C_2$ to $C_{100}$ hydrocarbyl

14. The composition of claim 13 wherein the oligomer/polymer is derived from pyromellitic dianhydride partial ester and diol and has a general structure as follows:

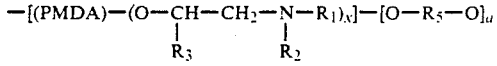

Where a=0.25 to about 2 x=0.5 to about 3.5

15. The composition of claim 13 wherein the oligomer/polymer is derived from pyromellitic dianhydride mixed partial ester and diol and has a general structure as follows:

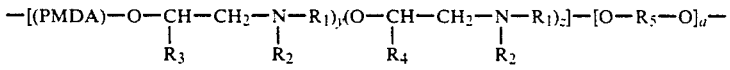

Where a=0.25 to about 2 y+z=0.5 to about 3.5

$R_4$=hydrogen or $C_1$ to about $C_{100}$ hydrocarbyl

16. The composition of claim 13 wherein the oligomer/polymer is derived from pyromellitic dianhydride partial ester/amide and diol and has a general structure as follows:

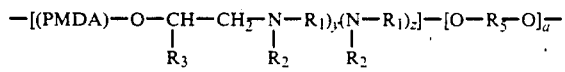

Where a=0.25 to about 2 y+z=0.5 to about 3.5

17. The composition of claim 12 wherein said additive product is obtained by by reacting di(hydrogenated tallow) amine, 1,2-epoxyoctadecane, pyromellitic dianhydride and 1,2-octadecanediol.

18. The composition of claim 12 wherein said additive product is obtained by reacting di(hydrogenated tallow) amine, pyromellitic dianhydride and 1,4-butanediol.

19. The composition of claim 12 wherein said additive product is by reacting di(hydrogenated tallow)

amine, 1,2-epoxyoctadecane, pyromellitic dianhydride, 1,12-dodecanediol.

20. The composition of claim 12 wherein said additive product is obtained by reacting di(hydrogenated tallow) amine, 1,2-epoxyoctadecane, pyromellitic dianhydride, and poly(ethyleneglycol).

21. The composition of claim 20 wherein the poly(ethyleneglycol) has an average M.W. of 400.

22. The composition of claim 20 obtained by reacting di(hydrogenated tallow) amine, 1,2-epoxyoctadecane, pyromellitic dianhydride, and poly(propyleneglycol).

23. The composition of claim 21 wherein the poly(propyleneglycol) has an average M.W. 2000.

24. The composition of claim 12 wherein said fuel is a liquid hydrocarbon combustible fuel.

25. The composition of claim 24 wherein the distillate fule is a distillate fuel.

26. The composition of claim 24 wherein the distillate fuel is selected from fuel oils.

27. The composition of claim 26 wherein the fuel oils are selected from heating fuel oil nos. 1, 2 & 3 and diesel fuel oil.

28. The composition of claim 22 wherein the fuel oil is a heating fuel oil.

29. The composition of claim 27 wherein the fuel oil is a diesel fuel oil.

30. The composition of claim 12 wherein said amount comprises from about 0.01 wt % to about 5 wt %.

31. A concentrate solution suitable for use in preparing liquid hydroarbyl fuels comprising a total volume of about 100 ml consisting of an inert solvent and about 10 g of an additive product as described in claim 1 dissolved therein.

32. The solution of claim 31 wherein said solvent is a hydrocarbon solvent.

33. The solution of claim 32 wherein said solution of claim 32 wherein said solvent is xylene or mixed xylenes.

34. A process for preparing a liquid hydrocarbyl fuel additive product of reaction comprising reacting in differing reactions a hydrocarbyl diol or mixture of hydrocarbyl diols and a reactive acid and/or anhydride derived from the reaction of pyromellitic dianhydride or its acid equivalent and hydrocarbyl groups derived from aminoalcohols, derived from secondary amines capped with an olefin oxide, having a combination of hydrocarbyl groups attached thereto and wherein said differing ratios are less than molar ratios, substantially molar ratios and more than molar ratios and where the temperature of reaction varies fro about 150° C. to 200° C. at pressure of from about 0.001 atm to 1 atm.

35. The process of claim 34 wherein said process is a one-pot process.

36. The process of claim 34 wherein the product is obtained by combining the reactants under standard esterification techniques in accordance with the following stepwise procedure:

$$\text{PMDA} + \text{HO}-\underset{\underset{R_3}{|}}{\text{CH}}-\text{CH}_2-\underset{\underset{R_2}{|}}{\text{N}}-R_1 + \quad (1)$$

$$\text{optionally } \text{H}-\underset{\underset{R_2}{|}}{\text{N}}-R_1 \longrightarrow \text{Reactive Acid/Anhydride}$$

$$\text{Reactive Acid/Anhydride} + \quad (2)$$

$$\text{HO}---R_5---\text{OH} \longrightarrow \text{Oligomer/Polymer}$$

$R_1$, $R_3$ = $C_8$ to $C_{30}$ hydrocarbyl groups,
$R_2$ = $R_1$, $C_1$ to $C_{100}$ hydrocarbyl, and
$R_5$ = $C_2$ to $C_{100}$ hydrocarbyl

37. The process of claim 36 wherein the oligomer/polymer is derived from pyromellitic dianhydride partial ester and diol and has a general structure as follows:

$$-[(\text{PMDA})-(\text{O}-\underset{\underset{R_3}{|}}{\text{CH}}---\text{CH}_2---\underset{\underset{R_2}{|}}{\text{N}}-R_1)_x]-[\text{O}-R_5-\text{O}]_a-$$

Where
a=0.25 to about 2
x=0.5 to about 3.5

38. The process of claim 36 wherein the oligomer/polymer is derived from pyromellitic dianhydride mixed partial ester and diol and has a general structure as follows:

$$-[(\text{PMDA})-\text{O}-\underset{\underset{R_3}{|}}{\text{CH}}-\text{CH}_2-\underset{\underset{R_2}{|}}{\text{N}}-R_1)_y(\text{O}-\underset{\underset{R_4}{|}}{\text{CH}}-\text{CH}_2-\underset{\underset{R_2}{|}}{\text{N}}-R_1)_z]-[\text{O}-R_5-\text{O}]_a-$$

Where
a=0.25 to about 2
y+z=0.5 to about 3.5
$R_4$=hydrogen or $C_1$ to about $C_{100}$ hydrocarbyl

39. The process of claim 36 wherein the oligomer/polymer is derived from pyromellitic dianhydride partial ester/amide and diol and has a general structure as follows:

$$-[(\text{PMDA})-\text{O}-\underset{\underset{R_3}{|}}{\text{CH}}-\text{CH}_2-\underset{\underset{R_2}{|}}{\text{N}}-R_1)_y(\underset{\underset{R_2}{|}}{\text{N}}-R_1)_z]-[\text{O}-R_5-\text{O}]_a$$

Where
a=0.25 to about 2
y+z=0.5 to about 3.5

40. A method of improving the low temperature properties of a liquid hydrocarbyl fuel comprising adding thereto a minor amount of from about 0.001 wt % to about 10 wt % based on the total weight of the composition of an additive product as described in claim 1.

* * * * *